US006752670B2

(12) United States Patent
Geil

(10) Patent No.: US 6,752,670 B2
(45) Date of Patent: Jun. 22, 2004

(54) SHIP PROPULSION SYSTEM COMPRISING A CONTROL THAT IS ADAPTED WITH REGARD TO DYNAMICS

(75) Inventor: Günter Geil, Bremen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/181,044

(22) PCT Filed: Jan. 8, 2001

(86) PCT No.: PCT/DE01/00027

§ 371 (c)(1),
(2), (4) Date: Nov. 12, 2002

(87) PCT Pub. No.: WO01/51351

PCT Pub. Date: Jul. 19, 2001

(65) Prior Publication Data

US 2003/0124919 A1 Jul. 3, 2003

(30) Foreign Application Priority Data

| | | |
|---|---|---|
| Jan. 14, 2000 | (DE) | 100 01 358 |
| Mar. 10, 2000 | (DE) | 100 11 601 |
| Mar. 10, 2000 | (DE) | 100 11 609 |
| Mar. 10, 2000 | (DE) | 100 11 602 |
| Dec. 18, 2000 | (DE) | 100 63 086 |

(51) Int. Cl.[7] ..... B63H 19/00
(52) U.S. Cl. ..... 440/1
(58) Field of Search ..... 440/1, 2, 4; 318/147, 318/148; 290/17

(56) References Cited

U.S. PATENT DOCUMENTS

| | | | | |
|---|---|---|---|---|
| 1,529,318 A | * | 3/1925 | Macmillan | 318/147 |
| 2,321,302 A | * | 6/1943 | Liwschitz | 318/148 |
| 2,454,778 A | | 11/1948 | Curry | 318/147 |
| 3,993,912 A | | 11/1976 | Ekstrom et al. | 290/17 |
| 4,036,164 A | * | 7/1977 | Kowach et al. | 440/1 |
| 4,338,525 A | * | 7/1982 | Kilgore | 290/17 |
| 4,759,731 A | * | 7/1988 | Uchida et al. | 440/1 |
| 4,794,316 A | | 12/1988 | Uchino et al. | 322/47 |
| 5,110,310 A | * | 5/1992 | Hobbs | 440/1 |
| 5,618,211 A | * | 4/1997 | Bourgoin | 440/4 |

FOREIGN PATENT DOCUMENTS

| | | |
|---|---|---|
| DE | 967 802 | 12/1957 |
| DE | 1180035 | 10/1964 |
| DE | 2 316 423 | 4/1973 |
| DE | 10011601 A1 | 2/2001 |
| EP | 0231840 B1 | 4/1993 |

* cited by examiner

*Primary Examiner*—S. Joseph Morano
*Assistant Examiner*—Lars A. Olson
(74) *Attorney, Agent, or Firm*—Harness, Dickey & Pierce, P.L.C.

(57) ABSTRACT

A ship propulsion system includes a ship electrical system and an electric propulsion system that is supplied with power from the electrical system, and which is equipped with a cascade control for the propeller motor. The rotational speed of the propeller motor is preset by a higher-order controller whose command variable is issued by the throttle lever. Filters means are provided for suppressing impairments to the ship's operation that result due to the high dynamics of the propulsion system.

63 Claims, 8 Drawing Sheets

SHIP PROPULSION SYSTEM COMPRISING A CONTROL THAT IS ADAPTED WITH REGARD TO DYNAMICS

This application is the national phase under 35 U.S.C. § 371 of PCT International Application No. PCT/DE01/00027 which has an International filing date of Jan. 8, 2001, which designated the United States of America and which claims priority on patent Application Ser. No. 100 01 358.9 filed Jan. 14, 2000, Ser. No. 100 11 602.7 filed Mar. 10, 2000, Ser. No. 100 11 601.9 filed Mar. 10, 2000, Ser. No. 100 11 609.4 filed Mar. 10, 2000, and Ser. No. 100 63 086.3 filed Dec. 18, 2000, the entire contents of which are hereby incorporated by reference.

FIELD OF THE INVENTION

The present application generally relates to ship propulsion systems.

BACKGROUND OF THE INVENTION

Propulsion devices for ship propellers with an electric propeller motor use rotation speed regulators for closed-loop control. A rotation speed nominal value is preset using the control lever on the bridge. Upstream of the input to the regulator, the rotation speed nominal value (reference variable) is compared with the rotation speed value at that time in order to determine from this a control error, which is supplied to the regulator. The output signal from the regulator is passed as a controlled variable to an actuating device, via which the propeller motor is connected to the current source.

When synchronous machines are used for propulsion, the actuating device is in the form of a frequency changer/converter, which uses the generator voltage from the diesel generator system to produce a suitable polyphase, variable frequency supply voltage. The converter circuit is designed such that the interconnection of the converter and synchronous machine results in a similar response to that from a DC machine whose current is controlled via a DC controller. The signal which is passed to the control input of the DC controller governs the current drawn by the DC machine. In the same way, the control signal from the regulator governs the current used to operate the synchronous machine. Asynchronous machines can also be supplied with electrical power, and can be used for ship propulsion, in the same way. It has now been found that propulsion systems of this type are relatively stiff, that is to say they are also able to regulate out minor rotation speed fluctuations which are within one propeller revolution.

The reason for rotation speed fluctuations and/or angular velocity changes is the behavior of the ship's propeller in the water which is flowing past the hull while the ship is in motion and whose speed profile is not three-dimensionally uniform. During their rotational movement, the propeller blades in some places move through the skeg or propeller-shaft stay on the ship's hull while, in the rest of their rotational movement, different water flow speeds impinge on them.

From the hydrodynamic point of view, the change in the load on the ship's propeller with time can be described by its wake field. The fluctuation in this load which is caused by the skeg or propeller-shaft stay on the ship's hull is once again evident in the inhomogeneity of the wake field of the propeller, which in turn results in a fluctuating angle of advance during revolution of the propeller blade.

Thus, the torque fluctuates cyclically, resulting in the ship's propeller having a fluctuating angular velocity which is regulated out by the rotation speed regulator, or by the current regulator that is subordinate to it, in order to keep the rotation speed of the ship's screw as exactly constant as possible at the preselected nominal rotation speed value. The frequency of the torque fluctuations corresponds to the shaft rotation speed multiplied by the number of blades on the propeller. The torque fluctuation is transmitted from the propulsion motor to its anchorage, and thus to the ship's hull. A torque reaction also occurs on the diesel generator system. In consequence, parts of the ship structure are caused to oscillate at the fundamental frequency of this pulsating torque and, as a result of the mechanical characteristics, the resonance of the ship's hull is not negligible at the relevant frequency. The vibration that this results in is not only annoying to those on the ship, but also results in a considerable load on the entire structure of the ship and its cargo, and should thus be avoided In the past, attempts have been made to calculate the weak points for such oscillations using the so-called finite element method and to reinforce the critical areas determined in this way by the use of tons of steel. This method is on the one hand expensive and on the other hand reduces the maximum permissible cargo weight and the useful cargo area of the ship, while increasing the fuel consumption and, furthermore, although it can reduce those effects of the oscillations produced by the propulsion that destroy material, it does not eliminate the cause, however.

Closed-loop rotation speed control, which keeps the rotation speed of the ship's propeller at the preselected nominal rotation speed value as exactly as possible, leads to a further negative effect.

Since the inhomogeneity of the wake field fully reflects the fluctuation in the angle of advance of the propeller, the cavitation safety margin of the propeller is reduced, since the operating point of a propeller becomes closer to its cavitation limit, or may even exceed it. Particularly in the region of a skeg or propeller-shaft stay on the ship's hull, the operating point of the propeller may reach or exceed the cavitation limit and thus initiate cavitation, which can then lead to considerable damage to the ship and, in particular, to the propeller. Cavitation also leads to unacceptable pressure fluctuations and noise, which considerably reduce, in particular, the useful value and comfort of passenger, research and naval ships.

The rotation speed of ship's propellers which are driven via electric motors can be adjusted very quickly. Rapid adjustment of the rotation speed also leads, inter alia, to cavitation on the propeller blades. In this case, the rate at which the rotation speed is adjusted depends on the speed of motion of the ship, that is to say on the incidence speed at which the water strikes the propeller.

For this reason, the ramp-up transmitters are provided, which, from the control engineering point of view, are located between the control lever and the nominal value input to the regulator.

When the actual rotation speeds of the ship's propeller increase, its dynamic response changes considerably. Since the family of curves for the propeller (transition from the towing curve to the free drive curve) follow a square law, the maximum permissible dynamic response of the ship's propeller decreases more than proportionally as the actual rotation speeds rise.

In the case of ship's propeller propulsion devices which are known from the prior art, the ramp-up time which is governed by the ramp-up transmitter is increased in one to three stages as the rotation speed of the propulsion motor for the propeller increases, in order to keep the excess rotation speed within the maximum permissible range of the propeller curve.

Furthermore, with regard to the power requirement, the electrical propulsion system also has to take account of the generator excitation. Its time response is slower than the possible dynamic response of the electrical machine for the ship's propeller.

Taking account of these two boundary conditions, the ramp-up transmitter from the prior art is designed as follows:

Starting from a rotation speed of zero, the propeller motor first of all accelerates without any restriction, that is to say optimally. The power consumed by the propeller rises more quickly while ramping up with a constant ramp-up time, and finally reaches a current limit in the rotation speed regulator, in order to avoid overloading the diesel generator system. At the end of the first stage of the ramp-up transmitter, a change is made to a different ramp-up time. The acceleration power which is available from the electrical propulsion decreases to virtually zero. This results in a sudden change in the power consumption from the diesel generator system, which it must, but cannot necessarily, regulate out. This leads to frequency and/or voltage fluctuations in the on-board power supply network.

At least in the first phase of the ramp-up time, the propulsion device draws electrical power from the diesel generator system, which in some circumstances leads to failure of the supply to the rest of the on-board power supply network.

When changing from the first ramp-up phase to the second ramp-up phase for acceleration of the ship, this results in the disadvantage that the ship is accelerated to only a very minor extent in certain rotation speed ranges.

With the propulsion device as described above, the current limit for the electrical machine for the propeller occurs at approximately 30% of the rated torque over the respective ship's propeller curve. The region between the current upper limit of the electrical propulsion machine and the calculated ship's propeller curve is required in order to provide a margin for heavy seas and/or ship maneuvers in addition to the acceleration torques which are required for the procedures involved in accelerating the ship.

The ramp-up transmitters which until now have been controlled in stages for propulsion devices for ship propellers are unable to allow the electrical machine which is driving the propeller to produce a defined acceleration torque during acceleration processes. In fact, over wide rotation speed ranges, they allow only the respective current limit at that time. The reason for this is that the acceleration time for the ship is several times the ramp-up time of the ramp-up transmitter type.

As has already been mentioned above, the diesel generator system has a power response with respect to time which can vary only more slowly than the power consumption of the electrical machine for the ship's propeller. Thus, in addition to the restrictions resulting from the propeller curve, it is also necessary to take account of the restrictions which result from the maximum dynamic response of the generator system.

When designing diesel engines for diesel generator systems for ships, the requirements of the International Association of Classification Societies (IACS) are taken into account with regard to the load response. The three-stage load change diagram associated with these requirements has a considerable influence on the dynamic response of the propulsion device for the ship's propeller in the case of present-day diesel engines, which use high boost levels. A further exacerbating factor is that the values that are known there are often no longer achievable nowadays, particularly in the upper power range, owing to inadequate maintenance and owing to the use of relatively poor quality bunker oil. The maximum possible dynamic response for power emission on the shaft of the diesel engine therefore, based on experience, decreases when the ship has been at sea for a lengthy time.

A further time gradient in the power emission from diesel engines, which is not specified according to the IACS or in any other generally binding form, is the thermal load capacity of the diesel engine. A smooth load change on a diesel engine at its operating temperature, from zero to the rated power or from the rated power to zero, may be carried out only within a minimum time, which is dependent on the physical size of the respective diesel engine. These times have fluctuated severely as a function of the physical size.

The time profile must not be exceeded, even in places, since, otherwise, this can lead to damage to the diesel engine.

The minimum times mentioned above may be between 10 and 20 seconds for small diesel engines, and up to 120 seconds for large diesel engines.

The converters/frequency changers which are connected between the diesel generator system and the electrical machine for the ship's propeller require a control wattless component. The control wattless component is dependent on the load. Examples of converters/frequency changers such as these include current intermediate circuit converters, direct converters, converters for DC machines and the like.

The wattless component is supplied from the synchronous generators in the diesel generator system. The time gradient of the load-dependent wattless component for the converters mentioned above with a control wattless component may vary 15 to 25 times more quickly than the terminal voltage of the synchronous generators, and the generator system cannot follow this. In particular, time is required to educe the excitation field for the synchronous generators.

If the dynamic limits of the diesel engines are exceeded when driving ship propellers, their rotation speed fluctuates, and hence the frequency of the on-board power supply network that is fed from the diesel generator system, to an unacceptable extent. It is also impossible to preclude damage to the diesel engines when the closed-loop rotation speed control for the generator system is intended to, or must, keep the frequency of the on-board power supply network within a permissible range, while ignoring the dynamic limits. If the dynamic limits of the synchronous generators are exceeded, the voltage of the on-board power supply network also fluctuates so severely that it departs from the permissible tolerance band.

According to the prior art, experiments have already been carried out based on multistage or continuous changes to the ramp-up times of the rotation speed nominal value and/or the current nominal value in the course of trial runs for such a long time that it has been possible to regard the interaction between the electrical machine for the ship's propeller and the diesel generator system as being satisfactory, without any unacceptable frequency or voltage fluctuations occurring in the on-board power supply network. In this case, it was often possible only to achieve optimization at certain operating points. There was no fixed relationship between the adjustment capabilities in the closed-loop control for the electrical machine for the ship's propeller and its dynamic effect on the diesel generator system in the on-board power supply network. The time profile for the reduction in the load on the diesel generator system was rarely taken into account, and was rarely adjustable, in the closed-loop control for the propulsion device for the ship's propeller.

SUMMARY OF THE INVENTION

Against this background, an object of an embodiment of the invention is to provide a ship propulsion system for a ship which has an electrical on-board power supply network. Preferably, one is provided which does not lead to reductions in comfort and/or to adverse effects on ship operation.

In particular, one aim is to make it possible to match, and to match the dynamic response of the ship propulsion system to the various types of boundary conditions mentioned above in a better manner.

According to an embodiment of the invention, an object may be achieved by developing a ship propulsion system. The reductions in comfort may be expressed in the form of oscillations in the ship's structure and/or in flickering lighting. The device according to an embodiment of the invention ensures that no fluctuations occur in the instantaneous value of the on-board power supply network voltage and/or in its frequency, going beyond a reasonable extent, irrespective of the speed at which the control lever and/or the rudder angle is adjusted.

Fluctuations could thus occur in the on-board power supply network voltage if the control lever were reset to zero too quickly, with the load being removed from the generator system more quickly than is possible to reduce the excitation of the synchronous machine. Conversely, fluctuations can also occur if the control lever is moved too quickly in the direction of high motor power. As a rule, the frequency falls in this case, because the diesel engine cannot accelerate sufficiently quickly.

Rudder movements have a similar effect on the generator system and/or the on-board power supply network. As the rudder is deflected, the load on the propeller rises, while the load on the propeller decreases when the rudder is moved to the null position.

Excessively rapid acceleration processes on the propeller can also lead to considerable noise, if the acceleration leads to cavitation on the ship's propeller.

The coupling of noise from the ship's hull and from the propeller into the water represents environmental pollution which propagates over wide areas and can considerably restrict the use of ships in corresponding protected areas, for example in the Arctic and Antarctic. The reduction in the noise emission as described above makes it possible, in particular, for passenger ships to be operated in traveling regions which are financially of particular interest and in which the fauna living there remain protected against dangerous noise and pressure fluctuations, by virtue of an embodiment of this invention.

In order to counteract vibration which is produced because the ship's propeller is subject to torque fluctuations in the moving water, the filters may include first filters which are set up to suppress amplitude fluctuations in the signal at the control input on the actuating device. Torque fluctuations result in changes to the angular velocity of the propeller shaft, which leads to corresponding ripple on the signal supplied from the rotation speed transmitter. Without an embodiment of the invention, the ripple would be reflected directly in the control difference and would lead to the current for the propeller motor, and hence its drive torque, fluctuating in accordance with this control difference.

The first filters filter out this ripple, that is to say the propulsion system may be provided with the capability to allow the rotation speed to flex when the propeller blades run into a high flow resistance, and allow the rotation speed to be resumed once the "difficulty impeding movement" has disappeared.

The filters which can be used for this purpose may be amplitude filters which pass on a signal change only when the signal change has exceeded a certain level. A filter such as this may be, for example, in the form of a diode characteristic. The other option is to use a frequency filter which acts as a low-pass filter and filters out the ripple that is superimposed on the control difference.

The frequency filter may be designed to be adaptive in such a way that the cut-off frequency varies with the rotation speed of the propeller shaft, or the voltage threshold varies with the basic value or equivalent value of the input variable. This ensures that an adequate dynamic response is provided in all rotation speed ranges, without the suppression of the ripple having any influence on the closed-loop control dynamic response, or the ripple penetrating through to the actuating device in another rotation speed range.

The first filter may be arranged between the regulator input and the rotation speed sensor, in the signal path of the signal with the control difference, or at the output of the regulator between the regulator and the control input of the actuating device. It is also possible for the filter to be implemented in the actuating device.

If the filters are in the form of an amplitude filter, they are expediently located in the signal path for the control difference. The closed-loop control device preferably has a PI control response.

The closed-loop control device may be designed in a classic manner as an analog closed-loop control device, or such that it operates digitally.

In the case of a PI regulator, the desired filter characteristic is achieved by feeding back the output signal from the closed-loop control device in antiphase to the input. The actuating device for the propeller motor may itself once again be in the form of a regulator. The control signal for the actuating device in this case preferably has the significance of a current nominal value. That is to say, the current controlled may be that emitted from the actuating device to the propeller motor, hence controlling the torque which is emitted by the propeller motor. Such open-loop control is also possible when the propeller motor is in the form of a synchronous machine and the actuating device is in the form of a frequency changer or converter. Circuits that are suitable for this purpose are known from the prior art.

If feedback is used in order to filter the ripple, this feedback is expediently set such that it results in a steady-state control error of approximately 0.2 to approximately 3% at the rated load. If this control error has a disturbing effect, it can be compensated for by means of an appropriately corrected nominal value. The nominal value compensation may be carried out as a function of the estimated load.

In order to suppress cavitation phenomena on the ship's propeller as a result of excessively fast acceleration, the filters expediently have second filters, which are in the form of controlled ramp-up transmitters. The ramp-up transmitter is used to match the rate of change of the rotation speed of the propeller shaft to the maximum permissible level.

For this purpose, the second filters may contain a characteristic in order that the rate of rise of the nominal value signal arriving from the control lever can be slowed down as a function of the rotation speed of the propeller motor. For this purpose, the second filters may be arranged between the input of the closed-loop control device and the control lever. At this point, it has no adverse effect on the control response, comprising a closed-loop control device, the actuating device and the ship's propeller.

The characteristic of the second filter may be considered continuous in the sense that it has no discontinuities. It does not necessarily need to be smooth in the mathematical sense, but may also be approximated in the form of a string of polygons. The only essential feature is that the transitions within the string of polygons have no discontinuities. The characteristic may be a square-law characteristic with an offset.

In order that the ship can still be maneuvered well in the low speed range, the characteristic may be designed, at least in the lower rotation speed range, such that the ramp-up time is constant and short, and rises only slightly with the rotation speed of the propeller. The propulsion system is then effectively "attached" directly to the control lever.

In a higher rotation speed range which starts at approximately 25 to 45% of the rated rotation speed, the ramp-up time increases with, or faster than, the rotation speed of the propeller motor. In consequence, the possible angular acceleration decreases the higher the rotation speed of the ship's propeller, irrespective of the rate at which the control lever is moved.

In an upper rotation speed range which starts, by way of example, at half the rated rotation speed, the rate at which the rotation speed of the propeller motor can increase is restricted even further, that is to say the ramp-up time increases even faster with the rotation speed, than in the rotation speed range below this.

However, it would also be feasible to control the rotation speed of the propeller motor such that it rises firstly in accordance with a square law with a short ramp-up time and then with an increase in rotation speed of the propeller motor, in order that the rate at which the rotation speed of the propeller can increase is slowed down in accordance with a square-root function plus an offset.

The second filter may be in digital form using a microprocessor, or may be designed such that it operates in analog form.

As already mentioned in the introduction, reductions in comfort also occur when the on-board power supply network voltage fluctuates too severely, because the generator system cannot follow the change in the power requirement for the ship propulsion sufficiently quickly. Excitation of synchronous machines and, in particular, reduction in the excitation of synchronous machines, require time. If the power consumption by the ship propulsion changes more quickly than it is possible for the excitation/reduction in excitation to take place, the on-board voltage departs from the permissible tolerance band, and this unnecessarily loads, or overloads, the appliances which are connected to the on-board power supply network. The diesel drive for the generators cannot follow this sufficiently quickly either, and this can lead to damage to the diesel engine.

In order to eliminate adverse effects resulting from this, the filters may have third filters, which restrict the rate of change of the power consumption by the propeller motor, to be precise to values which the on-board power supply network system can follow without any problems.

The third filter may once again be arranged either in the signal path of the nominal value signal, that is to say between the regulator and the control lever, downstream of the closed-loop control device or in the actuating device itself. The arrangement downstream from the regulator or downstream from the subtraction point has the advantage of also slowing down state changes which are caused by changes in the propeller load. Such changes in the propeller load occur when moving the rudder or when switching off or throttling down a propeller in multishaft systems.

The third filters have expediently been embodied in digital form, based on microprocessors. The third filters may also be of classic design, and may operate in analog form.

The third filters may be designed such that they limit the rate of change, when the control lever is moved in the direction of greater power consumption, to values which are different to those used when the control lever is moved in the direction of low power values.

The limit to the rate of change decreases at least in an upper power range or rotation speed range of the propeller motor.

The rate of change which the third filters allow may also be dependent on the number of generators feeding the on-board power supply network. A further influencing variable may be the operating state of the system, that is to say whether the system is already in a warmed-up steady state or is still in the warming-up phase, that is to say it is dependent on the total operating time. Finally, a further influencing variable is the load on the generator system, that is to say whether the load is in the lower, the medium or the upper power range of the diesel engines.

In order that the ship remains maneuverable and, in addition, that no control oscillations occur which are caused by the limiting of the rate of change, the third filters may be designed such that they provide a window within which the third filters do not influence the rate of change at which the signal of the control input of the actuating device changes. A window such as this is particularly expedient when the third filters are located in the signal path between the closed-loop control device and the actuating device. If the third filters are located between the control lever and the nominal value input of the closed-loop control device, such a window is in some circumstances unnecessary. Those combinations of features which are not reflected by an exemplary embodiment are also intended to be covered by the scope of protection.

Where the patent claims refer to a "ship's propeller" and a "propeller motor", then it is obvious to those skilled in the art that the invention is not restricted to a single motor and a single ship's propeller, but that a number of motors or ship's propellers may also be controlled jointly or separately from one another. Furthermore, the invention relates equally to surface vessels and underwater vessels.

BRIEF DESCRIPTION OF THE DRAWINGS

Exemplary embodiments of the invention are illustrated in the drawings, in which.

DETAILED DESCRIPTION OF THE PREFERRED EMBODIMENTS

Figure 1:
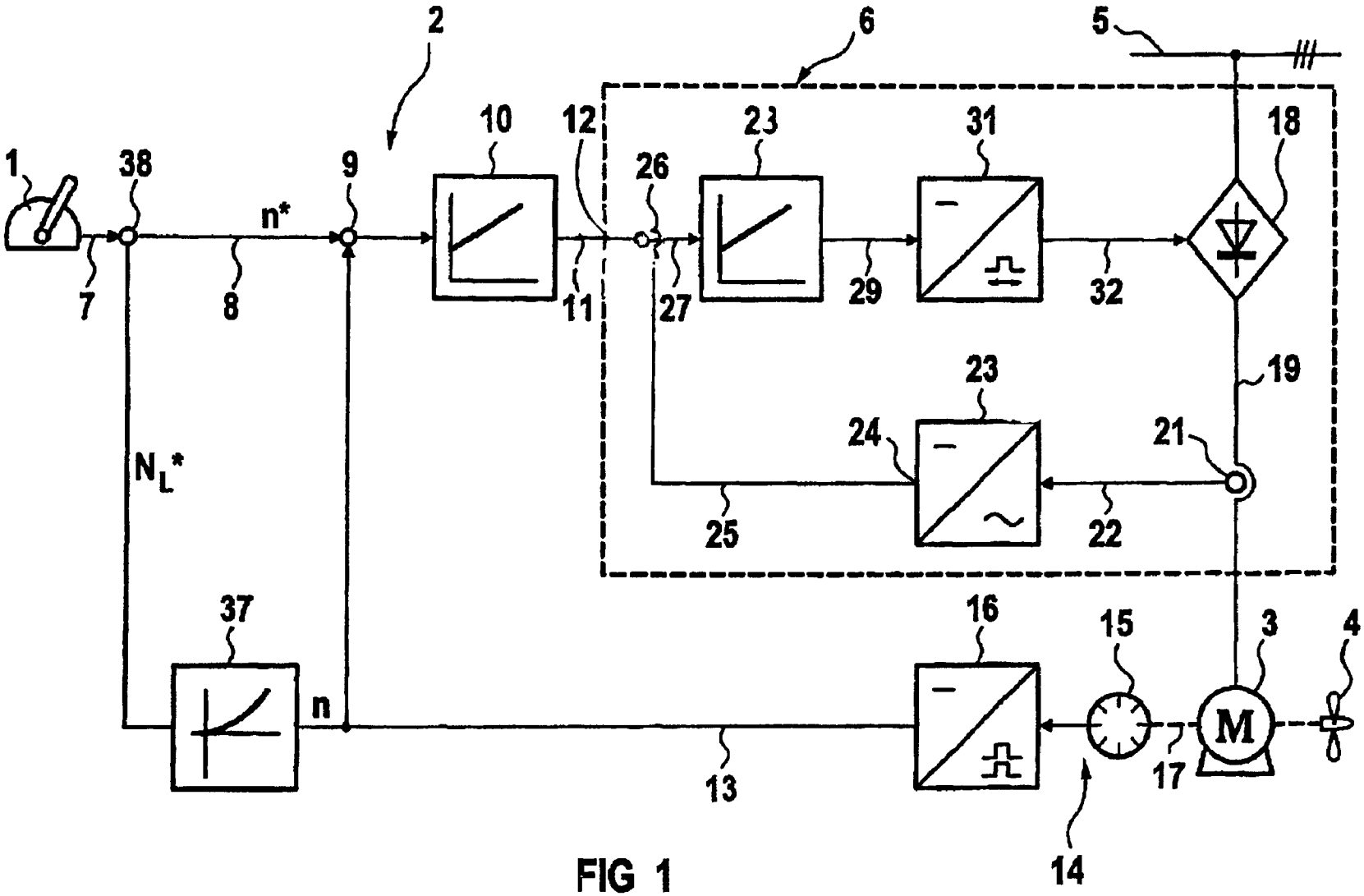
FIG. 1 shows a block diagram of a ship propulsion system with first filters for reducing oscillations in the hull caused by the behavior of the propeller in the water.

FIG. 1 shows a block diagram of an electrical ship propulsion system. The block diagram shows only those parts which are significant to the idea of embodiments of the invention. The detailed circuit diagram of the ship propulsion system is, of course, considerably more complicated, but this would detract from the illustration of all the details of only the idea of embodiments of the invention, and would make understanding more difficult.

The ship propulsion system includes a control lever 1, which is arranged on the bridge, a closed-loop control device 2, a propeller motor 3 for driving a ship's propeller 4, a schematically indicated on-board power supply network 5 and an actuating device 6, via which the propeller motor 3 is connected to the on-board power supply network 5. In the present documents, the term control lever is used to represent all devices by means of which the speed of motion is preset at a high control level, such as automatic systems, that is to say a "cruise control" for ships.

The control lever 1 supplies an electrical signal, which corresponds to the rotation speed of the ship's propeller 4, as a reference variable via a connecting line 7 to a nominal value input 8 of the closed-loop control device 2. The closed-loop control device 2 contains an addition node 9 as well as a PI regulator 10, whose output 11 is connected to an input 12 of the actuating device 6.

The closed-loop control device 6 receives the actual value signal via a line 13, which is connected to a rotation speed sensor 14. The rotation speed sensor 14 is composed of a digitally operated rotation speed transmitter 15 and a digital/analog converter 16 with rotation direction identification.

The rotation speed transmitter 15 is connected to a propeller shaft 17, on which the propeller motor 3 works and on which the ship's propeller 4 is seated such that they rotate together. The digital/analog converter 16 uses two phase-shifted cyclic digital signals coming from the rotation speed transmitter 15 to produce, in a known manner, a signal which is proportional to the rotation speed and with a mathematical sign, and this is passed to the line 13. This signal, which is proportional to the rotation speed of the ship's propeller 4, is compared at the addition node 9 of the closed-loop control device 2 with the signal coming from the control lever 1.

The rotation speed sensor 14 may, alternatively, be an indirect measurement system. The rotation speed is detected by means of the time profile of the current and voltage, preferably in the actuating device 6 or in the connecting line 19 for the propeller motor. The difference which is obtained from this is processed in the PI regulator 10, in accordance with its characteristic. The control response of a PI regulator is known, and does not need to be explained in any more detail at this point.

The actuating device 6 is once again itself designed in the form of a regulator, and contains a controller 18, for example composed of GTOs connected in a bridge circuit, which are connected in series between the polyphase, for example three-phase, on-board power supply network 5 and the propeller motor 3.

The propeller motor 3 is, by way of example, a synchronous machine, and the controller 18 is controlled such that it receives an appropriate polyphase, variable frequency AC voltage. A current sensor 21 is located in a connecting line 19 between the controller 18 and the propeller motor 3, and is connected via a line 22 to a converter circuit 23. The current sensor 21 may likewise be arranged on the input side of the controller 18.

The converter circuit 23 produces a DC signal from the AC signal which is detected by the current sensor 21, and this DC signal corresponds, by way of example, to the total root mean square value of the current flowing into the propeller motor 3. The converter circuit 23 accordingly emits at its output 24 a DC signal which is supplied via a line 25 to an addition node 26. In the addition node 26, the signal from the current sensor 21, which is proportional to the current, is compared with the output signal from the closed-loop control device 2, for which reason the other input of the addition point 26 is connected to the input 12 of the actuating device. The difference obtained in this way between the current nominal value and the current actual value is passed via a line 27 to a further PI regulator 28, whose output signal is fed via a line 29 into a drive circuit 31, which uses the regulator output signal to produce control signals, in the correct phase, for the controller 18, which is connected to the drive circuit via a multipole line 32.The actuating device 6 in the present case forms a converter. The propeller motor may also be an asynchronous machine, instead of the synchronous machine. It is likewise possible to use a DC machine, which may be fedwith alternating current.

The flow field of the water flowing past the ship's propeller 4 differs in three dimensions. The nonuniform flow distribution prevents the ship's propeller 4 from always experiencing the same resistance torques in the water throughout one complete revolution. When its propeller blades enter certain flow areas, they meet an increased resistance. This three-dimensionally different resistance leads to torque fluctuations if the propulsion shaft 17 is driven at an exactly constant rotation speed.

The constant shaft rotation speed results in opposing torques being created in the propeller motor 3, and these are transmitted to the ship structure. As soon as the propeller blade emerges from the area of high flow resistance once again, the torque falls until the next propeller blade enters this flow area. The torque which the propeller motor 3 must apply thus fluctuates cyclically at a frequency which is equivalent to the product of the shaft rotation speed and the number of propeller blades.

The torque fluctuations result in fluctuations in the angular velocity, and are detected as angular velocity changes by the rotation speed sensor 14. The closed-loop control device 2 tries to regulate out the rotation speed fluctuations, in order to drive the propeller shaft 17 at a constant rotation speed. This results in considerable vibration in the ship's hull.

The signal which is passed to the control input 12 of the actuating device 6 is composed, assuming that no further measures are taken, of a DC component on which a ripple is superimposed, corresponding to the torque fluctuations. According to an embodiment of the invention, the closed-loop control device is equipped with first filter(s), whose purpose is to suppress the previously mentioned ripple.

As soon as the signal reaching the control input 12 is free of this ripple, the propeller motor 3 can drive the ship's propeller 4 with a constant torque. The angular velocity of the propeller shaft 17 will now vary cyclically corresponding to the "instantaneous resistance to movement" of the ship's propeller 4 in the water. For this purpose, the propeller motor 3 is largely free of cyclic torque fluctuations which could stimulate the ship structure to vibrate.

Figure 2:
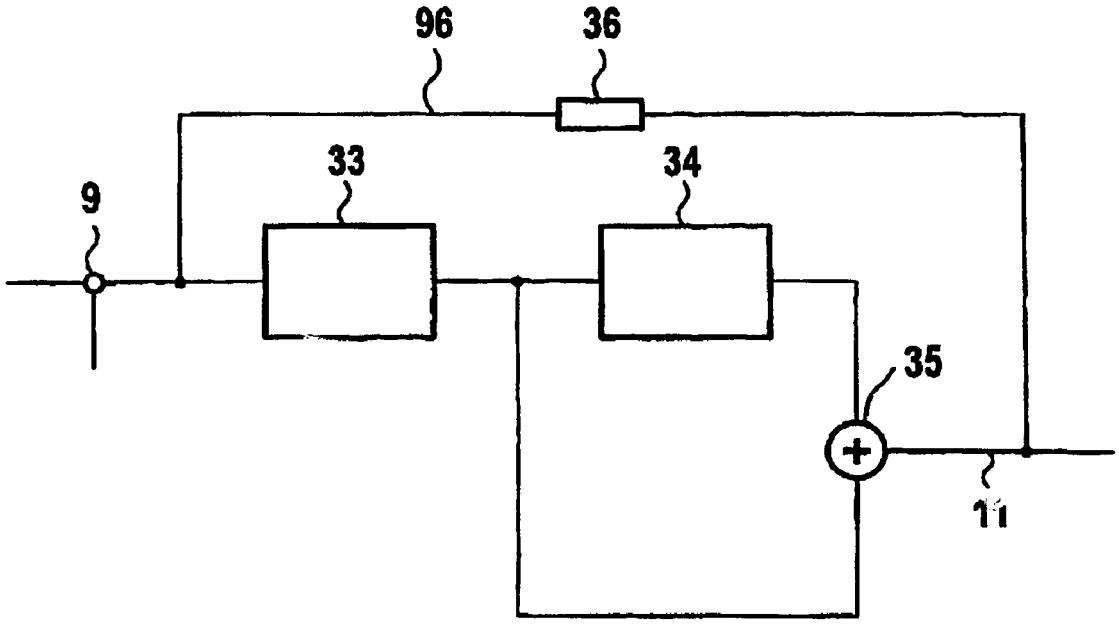
FIG. 2 shows the closed-loop control device as shown in FIG. 1, in the form of a detailed block diagram.

FIG. 2 shows one option for the implementation of the first filters. The regulator 10 contains, on the input side, a proportional regulator 33, which is connected on the input side to the addition point 9 and is connected on the output side to an input of an integral regulator 34. The output of the integral regulator 34 is connected to an input of an addition point 35, whose other input is connected to the output of the proportional regulator 33. The output of the addition point 35 forms the output of the regulator, to which the connecting line 11 is connected. A feedback resistance 36 leads from the line 11 to the input of the regulator 33, feeding the output signal back in antiphase to the input.

A regulator designed in such a way has, when seen overall, a low-pass/amplification response, which is able at least to reduce the ripple caused by the torque fluctuations from the ship's propeller 4.

The feedback resistance 36 varies the overall gain. In the event of any error between the rotation speed actual value n and a rotation speed nominal value n*, the modified rotation speed nominal value n* is virtually reduced by a value $n_R = R \times I^*$, when the actuating device 6 produces a finite current nominal value I*, in order to produce an opposing torque.

In consequence, the actuating device 6 tries to regulate itself only to the correspondingly reduced rotation speed nominal value $n^* - n_R$, thus providing the propeller motor 3 with the opportunity, by reducing n from n* into $n^* - n_R$, to release flywheel energy from the propulsion run, comprising the propeller motor 3, the ship's propeller 4 and the propeller shaft 17. In the process, the closed-loop control device 2 compares the falling motor rotation speed n virtually with a falling rotation speed nominal value $n^* - n_R$ and in consequence scarcely needs to carry out any opposing control action. In consequence, the propeller motor 3 does not produce any additional torque, or produces only a small amount of additional torque, so that no increased torque is introduced into the ship's hull at the major anchoring point.

As soon as the propeller blades have assumed a different position, the load on the propeller shaft 17 falls, and the rotation speed n rises once again, without increasing the motor torque. Since the rotation speed actual value n is now greater than the virtual rotation speed nominal value $n^* - n_R$, the amplitude of the regulator output signal falls, and the system reverts to the initial operating point. Since the rotation speed during a cycle such as this can flex only downward, the mean value of the rotation speed n falls somewhat in comparison to the actual constant rotation speed nominal value n*, which is evident as a permanent control error of approximately 0.2 to 3%. In order to counteract this effect, a compensation circuit may be inserted in the reference variable channel, that is to say between the control lever 1 and the addition point 9, shifting the rotation speed nominal value n* virtually upward by a corresponding amount. In this case, particularly in the case of ship propellers, it is possible to make use of the fact that the load torque of the propeller 4 rises approximately with the square of its rotation speed n so that, in consequence, the fed back signal, which is fed back via the resistance and is approximately proportional to the drive torque of the propeller motor 3 in the steady state, is also approximately identical to the rotation speed nominal value n*, as a square-law function of the rotation speed mean value n~. The compensator accordingly has to have a branch which rises with the square of the rotation speed nominal value n*.

The line 13 may contain a function transmitter 37 in a corresponding way, which produces the compensation described above and supplies it as a signal $N_L^*$ to an addition point 38 in the line 7. In consequence, the rotation speed nominal value n* is raised by a value $n_L^* f(n)$. Thus, in the steady state, $n_L^* = -n_R$ and this has the desired effect that the sum of the signal 8 and the signal 35 is equal to the signal 6 at the addition point 9.

In the embodiment shown in FIG. 2, the fluctuations in the regulator output signal, which are proportional to the torque, are fed back with a phase shift of approximately 180° to the rotation speed regulator input thus resulting firstly in negative feedback and hence stable feedback, and secondly in the torque which is required to regulate out the load-dependent fluctuations in the rotation speed, and the regulator output signal which is approximately proportional to this, being reduced. The primary consequence of this is that the fluctuations in the drive torque can be considerably reduced, so that the torque fluctuations emitted via the motor anchoring to the ship's hull and the torque fluctuations which are emitted via the ship's propeller to the wake field of the ship's propeller can be reduced to non-critical values.

One side effect in this case is that the rotation speed of the propeller now no longer remains exactly constant, but is subject to certain fluctuations, as caused by the alternating load. However, this is of very minor importance for the propulsion that is produced by the propeller while, on the other hand, it is in this case possible advantageously to use the moment of inertia of the rotor of the electric motor, of the propeller and the shaft to damp these fluctuations. Since the rotating bearings for the shaft have virtually no friction, the ship's hull is not stimulated by these rotation speed fluctuations.

From the hydromechanical point of view, this effect has the major advantage that the rotation speed of the propeller now no longer remains exactly constant but is subject to certain fluctuations which are caused by the alternating loads on the propeller. In consequence, this reduces the fluctuation width resulting from the hydromechanical coupling of the wake field to the angle of advance. This reduction in the fluctuation width of the angle of advance results from the fact that the fluctuation in the load on that propeller blade which is located in the inhomogeneous wake field of the skeg or propeller-shaft stay that is located on the ship's hull leads to a change in the rotation speed by virtue of the above effect of an embodiment of the invention.

On the basis of its direction and magnitude, the change counteracts the cause. This leads to a change in the rotation speed and thus to damping of the fluctuation width of the angle of advance of that propeller blade which is most at risk of cavitation. The reaction from this propeller blade on the other blades of the propeller resulting from the described effect is of minor importance, since their operating points remain considerably closer to the rated operating point of the propeller than the operating point of that propeller blade which is located in the inhomogeneous part of the wake field of the skeg or propeller-shaft stay that is provided on the ship's hull.

It is within the scope of the embodiments of the invention for the fed back output signal from the rotation speed regulator to be multiplied by a factor. This feedback should not, of course, be chosen to be too strong since, otherwise, the approximately constant mean value of the drive torque, which is likewise fed back, would result in an excessive reduction in the rotation speed nominal value occurring, so that the rotation speed regulator would itself no longer be able (assuming that this rotation speed regulator has a PI characteristic) to accelerate the propulsion shaft to the selected rotation speed nominal value. Since, on the other hand, a predetermined voltage range is available both for the regulator input signal and for its output signal, for example from −10 V to +10 V, with each of these limits corresponding to the maximum rotation speed for forward propulsion and propulsion astern, and to the maximum motor torque, multiplicative matching of these two signal levels is essential for setting the optimum feedback level.

The multiplication factor may be between 0.01% and 5%, preferably between 0.1% and 3.0%, and especially between 0.15% and 2%. This is negative feedback that is naturally at a very low level since—as already mentioned above—the majority of the power which is required by the changing load can actually be provided by the moment of inertia of the rotor of the electric motor, of the propeller and of the propulsion shaft and can in each case be fed back once again to it.

Since embodiments of the invention can result in a certain amount of freedom for rotation speed fluctuations, the propulsion run may advantageously be used as an energy store which, in a similar way to the energy storage capacitor in an electrical power supply, leads to smoothing of the power consumption from the electrical power supply network for the propulsion system. A small amount of negative feedback thus leads to the significant result that the torque applied by the propulsion motor is largely smoothed without this causing any significant, permanent control error from the preselected nominal value.

With regard to the amount of negative feedback, a setting has been proven in which the steady-state control error is between approximately 0.2% and 2% at the rated load. In this case, despite the negative feedback of the regulator output signal, the closed-loop control quality is not adversely affected, in particular the dynamic response to changes in the rotation speed nominal value.

One compensation method which is preferred by an embodiment of the invention uses the estimated, mean load on the propulsion as an output variable, and attempts to determine the steady-state control error to be expected by mechanical recording of the path parameters from this, and to compensate for this control error by appropriate, reciprocal adjustment of the rotation speed nominal value.

In many cases, in particular also in the case of propeller propulsion systems for ships, the characteristics of the controlled system are at least approximately known. In particular, the steady-state, mean load torque based on a characteristic is obtained from the steady-state rotation speed actual value. By way of example, in the case of propeller propulsion systems, the drive torque rises approximately with the square of the rotation speed actual value. If the rotation speed actual value is thus intended to correspond to a specific rotation speed nominal value it is possible to use this characteristic to determine, approximately, that torque which is approximately proportional to the regulator output signal in the steady state. Thus, the mean value of the fed back signal, and hence the residual control error, can also be determined. This is superimposed on the nominal value, preferably additively, thus resulting in the ideal rotation speed nominal value as the rotation speed actual value itself when control errors that have been calculated in advance occur.

Owing to the reduction in the oscillation amplitude, there is no need for expensive reinforcement of the ship's hull in the region of critical points calculated using the finite element method. This results in a considerable reduction in the computation complexity and design effort, as well as in considerable material savings and in the assembly time being shortened.

The filters for suppression of the oscillations in the ship's hull resulting from the inhomogeneities during revolution of the ship's propeller 4 may also be suppressed via a classic low-pass filter. The cut-off frequency of the low-pass filter is in this case expediently readjusted as a function of the rotation speed of the propeller shaft 17. The aim of this is to additionally suppress low-frequency components at low propeller rotation speeds without adversely affecting the closed-loop control system dynamic response, in consequence, at high rotation speeds. The rotation speed of the ship's propeller 4 still passes through a range of more than two powers of ten. In some circumstances, a fixed cut-off frequency is not sufficient. A low-pass filter such as this can be produced by a digital solution, with the filtering being carried out by a convolution function with a suitable cut-off frequency.

Figure 3:
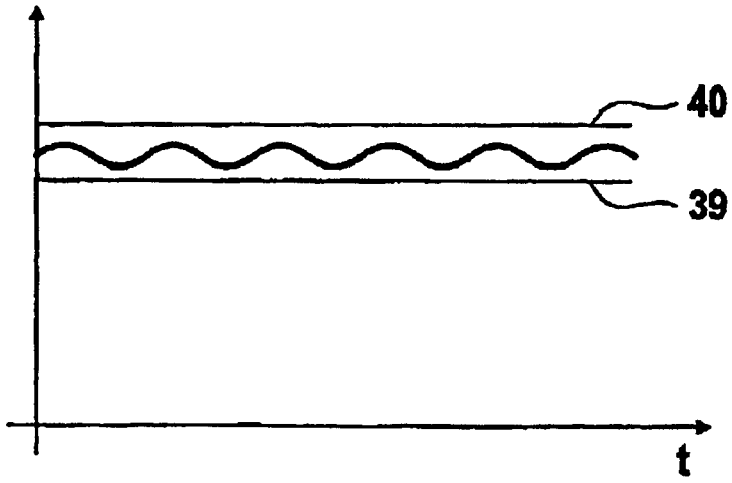
FIG. 3 shows the transmission response of an amplitude filter.

Instead of carrying out the filtering process in the frequency domain, the ripple can also be suppressed by carrying out the filtering process in the amplitude domain. FIG. 3 shows, schematically, the signal which is produced at the output of the PI regulator 10 without any filtering. As shown, this is composed of a steady-state component and the superimposed ripple, which has already been mentioned a number of times.

The filtering is carried out by using a microprocessor and the program contained in it to determine a lower limit 39, which is below the troughs of the oscillation amplitude of the ripple. An upper limit 40 is defined, matching this lower limit 39, with a certain safety margin from the peaks of the ripple. As long as the incoming signal is between these two limits 39 and 40, a previously defined mean value, for example the mean value between the limits 39 and 40, is passed to the control input 12. Appropriate readjustment is carried out only when one of the limits 39, 40 is infringed as a result of a greater error occurring due to movement of the control lever 1.

Such amplitude filtering can be carried out particularly easily using a microprocessor. However, it is also possible to use a nonlinear amplification characteristic for this purpose, such as that provided by a diode for example. An amplitude filter such as this is expediently accommodated between the addition node 9 and the input of the proportional regulator 33.

The nonlinear transmission relationships result in the ripple in the region of the zero being suppressed, while large signals are passed through.

Figure 4:
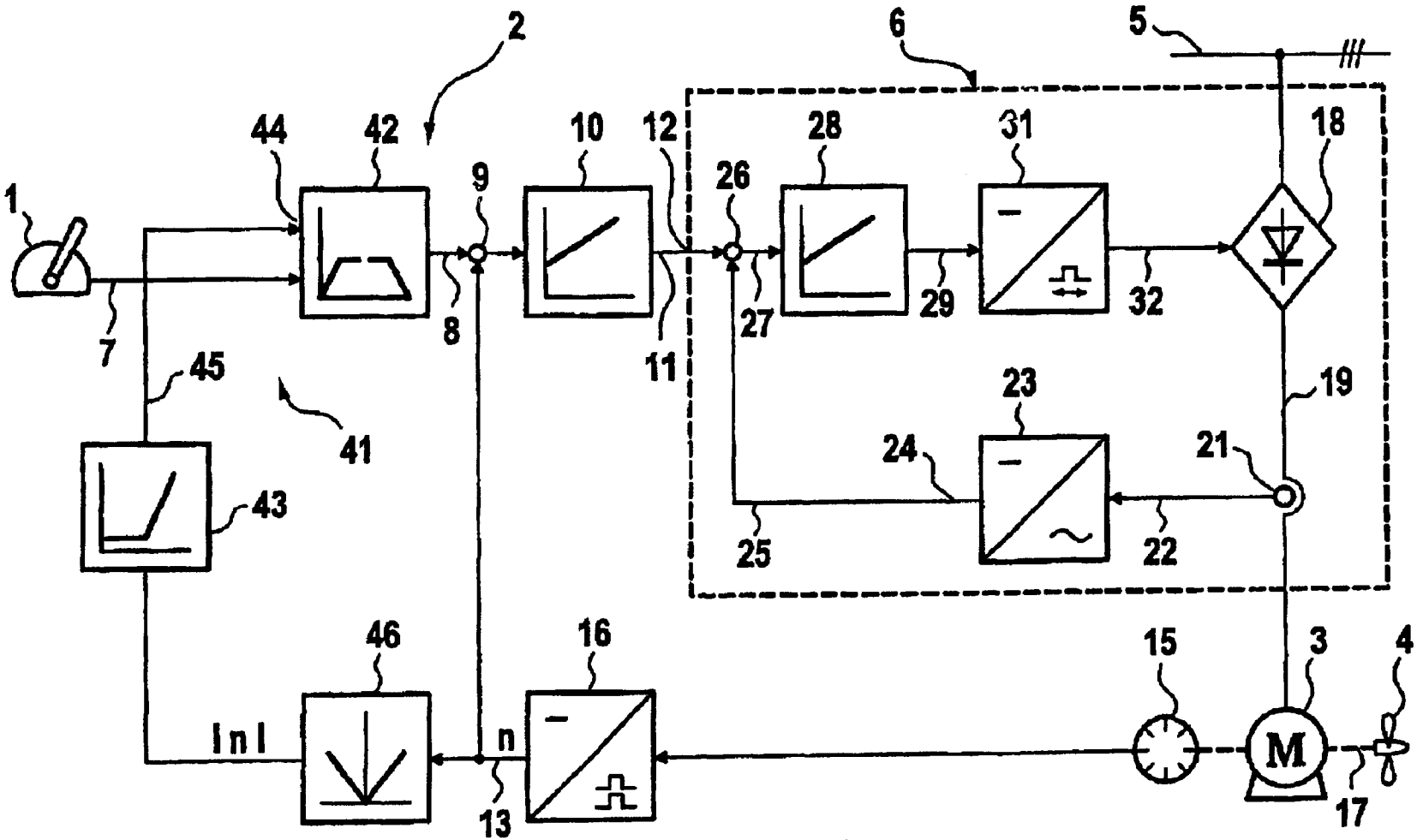
FIG. 4 shows a block diagram of a ship propulsion system with second filters for matching the dynamic response to the dynamic response of the ship's propeller.

FIG. 4 shows a highly schematic block diagram of a ship propulsion system according to the invention, in which second filter means 41 are implemented, which are used to match the possible dynamic response from the actuating device and propeller motor to the possible and permissible propulsion dynamic response of the ship's propeller 4. Cavitation phenomena on the ship's propeller during acceleration processes are thus suppressed.

Where functional groups that have already been explained above occur in this block diagram, these will not be described once again, and the reference symbols from the previous figures are used for these functional groups. The first filter and the compensation circuit have been omitted from FIG. 4, for reasons of simplicity.

The second filter 41 for the ship propulsion system as shown in FIG. 4 includes a ramp-up transmitter 42. The ramp-up transmitter 42 is located in the connecting line 7 which connects the control lever 1 to the nominal value input 8 of the addition node 9. The second filters 41 are thus located in a reference variable channel.

Another component of the second filter 41 is a characteristic transmitter 43, which is connected to a control input 44 of the ramp-up transmitter 42 via a line 45. On the input side, the characteristic transmitter 43 is connected to the output of a circuit assembly 46, to whose input side the rotation speed signal is supplied from the connecting line 13. The circuit assembly 46 is used to produce the magnitude of the rotation speed signal. The purpose of the second filter 41 is to limit the rate of change of the nominal value signal, as it arrives from the control lever 1, to values which ensure that the ship's propeller does not produce foam and has no tendency to cavitate. Irrespective of how quickly the control lever 1 is moved in the sense of acceleration, the nominal value at the appropriate input of the addition element 9 moves only at a lower rate.

Filters such as these can preferably be produced on a microprocessor basis. In order to achieve the desired limiting, the signal coming from the control lever 1 may, for example, be differentiated, limited in accordance with the characteristic transmitter 43 and then integrated once again, in order to obtain the basic signal, but whose rate of rise has now been changed.

For this reason, the characteristic transmitter 43 receives a signal which is dependent on the rotation speed, because the limiting of the rate of change is thus dependent on the ramp-up time for the rotation speed of the ship's propeller 4. The magnitude of the actual rotation speed of the propeller shaft 17 is used as a reference variable for the adaptive characteristic transmitter 43, and is hence indirectly used as a reference variable for the rate of rise of the nominal value signal which is passed on to the closed-loop control device 2.

Figure 5:
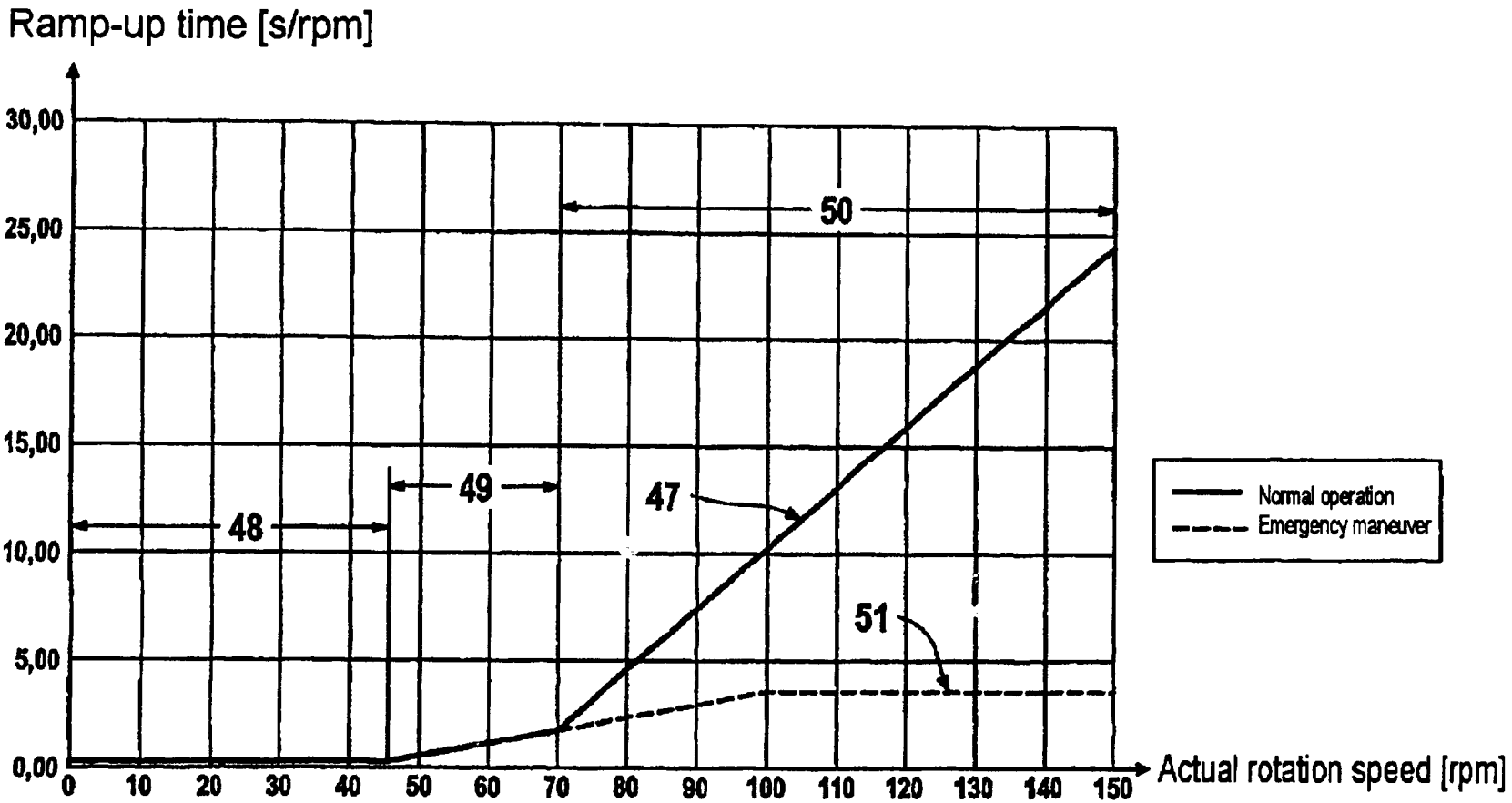
FIG. 5 shows the transmission characteristic of the second filters.

FIG. 5 shows the profile of the characteristic for the second filter 41. It can be seen from this that the characteristic is continuous, that is to say it has no discontinuities, and is approximated by a string of polygons. The characteristic 47 for normal operation is composed of three sections 48, 49 and 50, which are plotted against the actual rotation speed of the ship's propeller 4.

In the illustrated exemplary embodiment, the lower actual rotation speed range 48 extends from 0 to 46 rpm (up to approximately ⅓ of the rated rotation speed), the central actual rotation speed range 49 extends from 46 to 70 rpm (up to approximately half the rated rotation speed), and the upper actual rotation speed range 47 extends from 70 to 150 rpm (up to the maximum rotation speed).

As can be seen from FIG. 5, a constant, short ramp-up time in the order of seconds per rpm is predetermined in the characteristic transmitter 43 for the adaptive ramp-up transmitter 42 for the low actual rotation speed range 48 of the electric propeller motor 3, which may correspond, by way of example, to the range between 0 and ⅓ of the rated rotation speed. The electric propeller motor 3 and hence the ship's propeller 4 can operate with a high dynamic response in this maneuver range.

Figure 6:
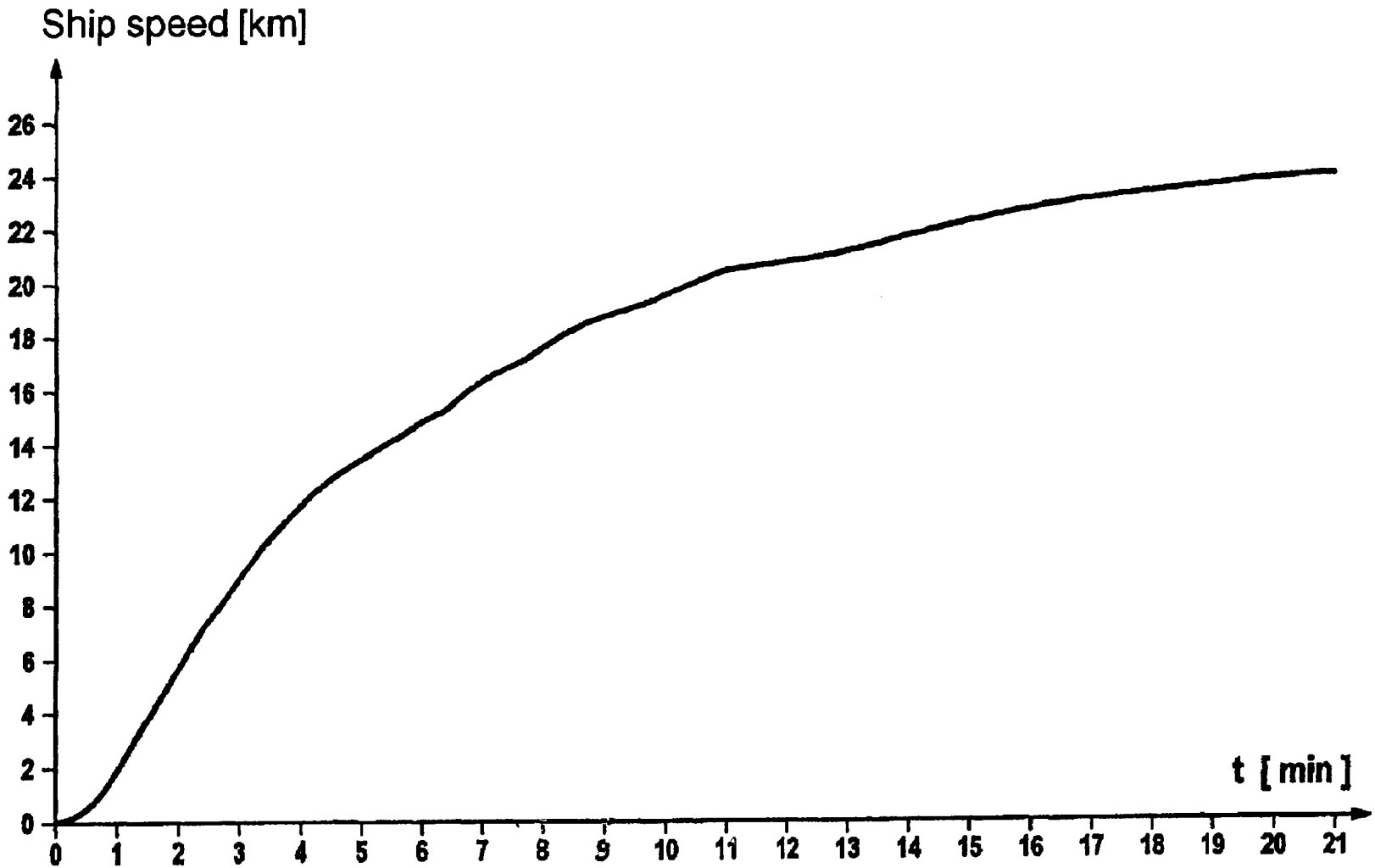
FIG. 6 shows the profile of the ship's acceleration for a ship which is equipped with the propulsion system according to an embodiment of the invention.

For the central actual rotation speed range 49, in FIG. 5, of the electric propeller motor 3, which is located approximately between 113 and half of the rated rotation speed of the electric propeller motor 3, the ramp-up time rises with a comparatively shallow gradient. Between the two limits of this central actual rotation speed range 49, the characteristic transmitter 43 of the adaptive ramp-up transmitter 42 changes into the propulsion mode, which corresponds to the higher actual rotation speed range 47 of the electric propeller motor 3. There, the ramp-up time rises with increasing actual rotation speed of the electric propeller motor 3 at a steeper gradient than in the central actual rotation speed range 49. Here, the characteristic transmitter 43 for the second filter 41 is given an even longer ramp-up time. The ramp-up time which is dependent on the rotation speed, allows the electric propeller motor 3 to be accelerated uniformly, without any current limit. This results in continuous ship acceleration, as is shown in FIG. 6. This acceleration curve has no discontinuities.

For deceleration processes, it is advantageous to be able to preset a constant ramp-down time in the second filter 41 and this may be, for example, 0.2 s per rpm.

The configuration of the characteristic 47 allows the acceleration of the electric propeller motor 3, and hence that of the ship's propeller 4 as well, to be varied freely. From the hydrodynamic point of view, this results in the major advantage that the operating point of the ship's propeller 4 can be influenced in an advantageous manner by optimum matching of the acceleration in the higher rotation speed range, or propulsion mode, 47. Thus, even during acceleration, the operating point of the ship's propeller 4 can be kept away from areas of undesirable, or even damaging, cavitation. This is a major financial advantage, since cavitation on a ship's propeller 4 leads to considerable noise, which considerably reduces the useful value in particular of passenger ships, research ships and naval ships.

Different characteristics for the ramp-up time may be stored in the characteristic transmitter 43 for the second filter 41. For example, FIG. 5 shows a characteristic 51 for an emergency maneuver in the region that is partially in the form of a dashed line, and which differs from the characteristic 47 for normal operation. Rapid acceleration can be allowed by selecting the characteristic 51 for emergency maneuvers, for example by operating a button on the characteristic transmitter 43. The ramp-up time to the ship's maximum speed for a ship which is propelled by the propulsion device according to the invention can thus, by way of example, be reduced by half, with the characteristic 51 for emergency maneuvering taking account exclusively of technically dependent limit values. In contrast, by way of example, the configuration of the characteristic 47 includes further aspects, with the configuration of this characteristic generally being chosen as a compromise between adequate ship maneuvering characteristics and operation of the entire machine system in a conservative manner. Optimization is possible with respect to various target functions such as minimum fuel consumption, minimum time passing, high ship maneuverability, etc. in alternative profile for the section 48 of the characteristic 47 in the characteristic transmitter 43 for the second filter 41 is a slight gradient which, however, is less than the gradient of the section 49.

It is also feasible for the characteristic in the characteristic transmitter 43 to be allowed to rise in accordance with the square law as the rotation speed of the propeller motor 3 increases and, in addition, to slightly emphasize a constant offset so that a short ramp-up time is actually set when the propeller motor 3 is rotating at low rotation speeds. A further alternative is to omit the circuit assembly 46 for the second filter, and to extend the characteristic transmitter 43 by adding the negative rotation speed range of the propeller motor.

If a ship is equipped with two propulsion devices according to an embodiment of the invention as described above, the load distribution between the two propeller shafts 17 of the electric propeller motors 3 is controlled via the adaptive ramp-up transmitters 42. The propeller shaft 17 with the lower load applied in this case has a somewhat lower actual rotation speed than the propeller shaft 17 to which the higher load is applied. In the higher actual rotation speed range 50, that is to say in the region of the propulsion mode of the electric propeller motor 3 or of the electric propeller motors 3, the adaptive ramp-up transmitter 42 with the lower rotation speed actual value always accelerates faster than the adaptive ramp-up transmitter 42 with the higher rotation speed actual value. While the ship is accelerating, this behavior results in uniform load distribution between the two propeller shafts 17, virtually automatically. This results in better directional stability during acceleration.

The response of the second filter 41 of the propulsion device according to an embodiment of the invention indicates that it is possible to add a definable acceleration torque to a steady-state load torque. This definable acceleration torque remains in the propulsion mode range, that is to say it remains to a certain extent constant in the region of the higher actual rotation speed range 47 of the electric propeller motor 3, and thus remains free of values which are unnecessarily high at times. By interaction with the first filter already described, and with the second filter 41 being readjusted, this has prevented, inter alia, the tendency of the ship's propeller 1 to cavitate or to produce foam.

Suitable circuits for readjustment of the ramp-up transmitter 42 contained in the second filter 41, by the rotation speed regulator, are known from the prior art. These are not illustrated in the figures, for reasons of simplicity.

Figure 7:
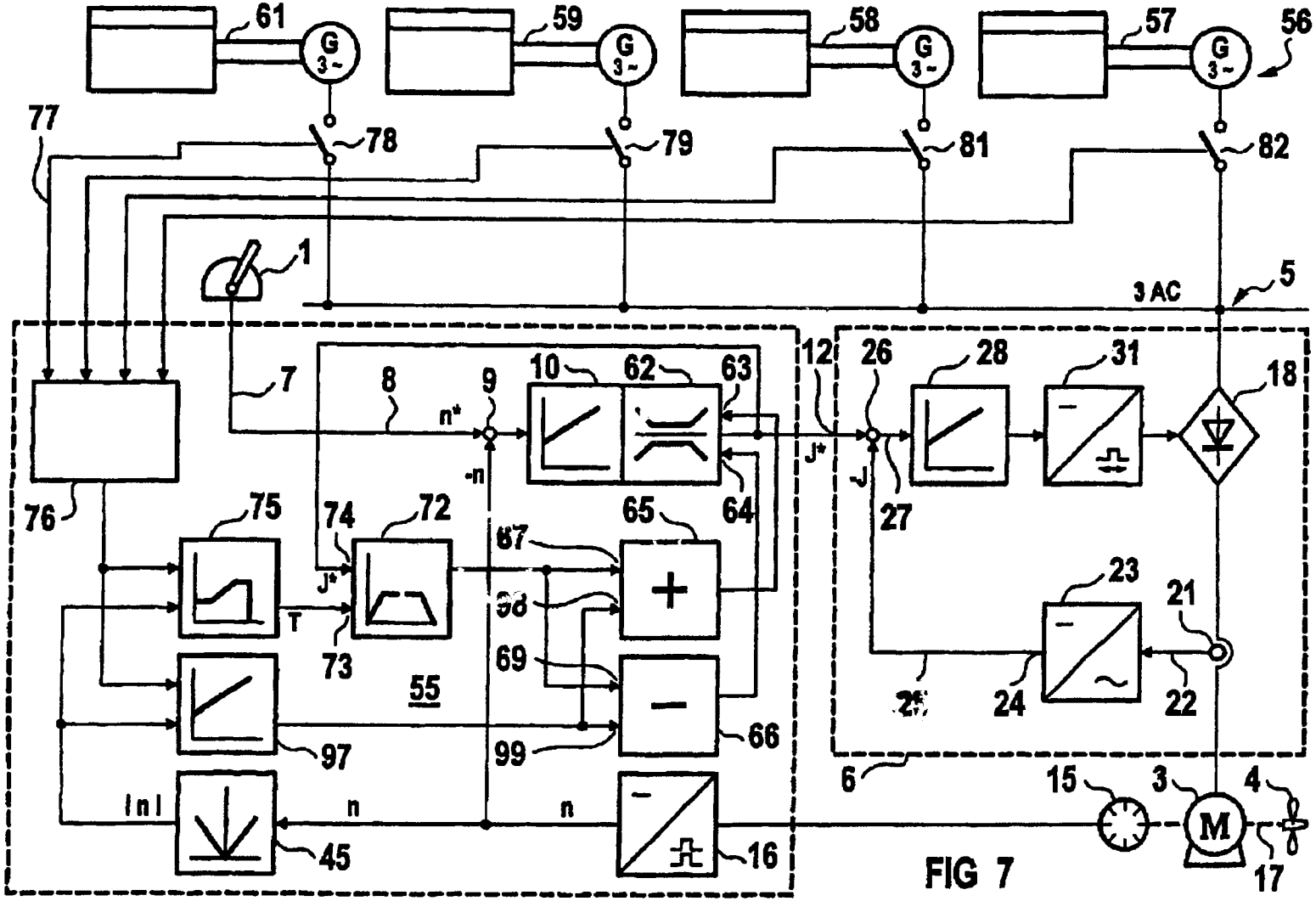
FIG. 7 shows a block diagram of a ship's propulsion system which is provided with third filters, in order to match the dynamic response of the propeller motor to the dynamic response of the generator system.

FIG. 7 shows a highly schematic block diagram of a ship propulsion system according to the invention, which has third filters 55 which are used to match the possible dynamic response from the actuating device and propeller motor to the possible and permissible dynamic response of the generator system. In consequence, voltage and/or frequency fluctuations in the on-board power supply network are suppressed during acceleration and deceleration processes.

Where functional groups which have already been explained above occur in this block diagram, these will not be described once again, and the reference symbols from the previous figures are used for these functional groups. The first and second filters, and the compensation circuit in FIG. 7, have been omitted for reasons of simplicity.

The on-board power supply network 5 is fed from a diesel generator system 56 having four diesel generators 57 . . . 61. The generators are in this case normally three-phase synchronous generators.

The third filters 55 have a limiting circuit 62, which is located between the output of the regulator 10 and the control input 12 of the actuating device 6.

The purpose of the limiting circuit 62 is to allow the output signal from the regulator 10 to become larger or smaller depending on the amplitude, or to limit an excessively fast rate of rise. The limiting circuit 62 has two control inputs 63 and 64, which are connected to an upper and a lower limit value stage 65 and 66. The upper and the lower limit stages define, via the control inputs 63 and 64, the rate at which the signal may vary in the upward or downward direction, respectively, and, furthermore, they have the characteristic of defining an amplitude window.

As long as the change in the amplitude of the output signal from the regulator 10 moves within this window, the rate of change is not influenced by the limiting circuit 62. The limiting circuit 62 starts to act only when the amplitude of the output signal from the regulator 10 varies more sharply than is defined by the two limit value stages 65 and 66.

The center and the size of the amplitude window, which is defined by the two limit value stages 65 and 66, are not rigid, for which reason the two limit value stages 65 and 66 have control inputs 67, 69. The control inputs 67, 69 are connected to one output of a characteristic transmitter 72 which has two control inputs 73 and 74, via which the ramp-up time and the ramp-down time are define. The input 74 is connected via an appropriate line to the control input 12, and thus receives information about the instantaneous value of the reference variable, which is passed to the actuating device 6.

The input 73 is connected to one output of a further characteristic transmitter 75, into which, firstly, the magnitude of the rotation speed signal as it arrives from the circuit assembly 45 and, on the other hand, a control signal from a logic circuit 76, are fed. The logic circuit 76 is connected via a control line 77 to switches 78, 79, 81 and 82, via which the individual generators 57 . . . 61 are connected to the on-board power supply network 5. The characteristic transmitter 75 defines the ramp up time and the ramp-down time for the ramp-up transmitter 72.

The size of the amplitude window, which is likewise defined by the two limit value stages 65 and 66, is not rigid, for which mason the two limit value stages 65 and 66 have control inputs 98, 99. The control inputs 98, 99 are connected to one output of a further characteristic transmitter 97, into which, on the one hand, the magnitude of the rotation speed signal as it arrives from the switching assembly 45 already described above, and on the other hand a control signal are fed, as made available by the logic circuit 76 which has already been described above.

The limit value stage 65 is expediently an adder, and the limit value stage 66 is a subtractor. The output from the ramp-up transmitter 72 produces the steady state of the torque-forming control signal, as is passed to the control input 12 of the actuating device 6. The output of the characteristic transmitter 97 produces the maximum sudden signal change in the torque-forming control signal that is permissible with respect to the steady state at the respective operating point, as is passed to the control input 12 of the actuating device 6.

The third filters 55 thus define the maximum permissible rate of change at which the nominal value signal for the actuating device 6 may vary, and hence by which the rotation speed of the propeller motor or motors 3 may vary, to be precise as a function of the rotation speed of the propeller motor 3, and of the number and load on the diesel generators which are connected to the on-board power supply network. A time change is carried out in conjunction with the limit value stages 65 and 66, that is to say the signal rate of change is influenced, but only when the signal change exceeds an amount which is defined in the limit value stages.

This window which is formed in this way is also dependent on the number of diesel generators 57 . . . 61 which are connected to the on-board power supply network 5, on the rotation speed of the propeller motor 3 and on the magnitude of the control signal for the actuating device 6.

In this way, the rate of change of the power consumption by the propeller motor or motors 3 is restricted to values which the diesel drives for the diesel generators 57 . . . 61 and/or the field excitation of the synchronous generators can follow without this leading to excessive voltage fluctuations and/or frequency fluctuations in the on-board power supply network 5.

In order that the ship can still be maneuvered well and in order that no control oscillations whatsoever occur either, an amplitude region of the signal which is located around the instantaneous value of the control signal of the input 12 is, however, uninfluenced by the limit to the rate of rise or rate of fall. If this were not done, there would be a risk of the change in the instantaneous value (caused by the closed-loop control of the drive) resulting from the rate of change limit, leading to control oscillations, and hence to beating in the drive.

The third filters are thus used to preset a ramp-up time and a ramp-down time for the reference variable, which is passed to the control input 12. The maximum permissible time loading of the diesel engines, and removal of load from the diesel engines, in the diesel generator system are taken into account when selecting these times. In order to take account of this, the ramp-up time and ramp-down time which are defined in the third filters 55 vary in proportion to the magnitude of the rotation speed of the propeller motor 3. The times may possibly also vary on the basis of the load at any given time on the diesel engines in the generator system.

Figure 8:
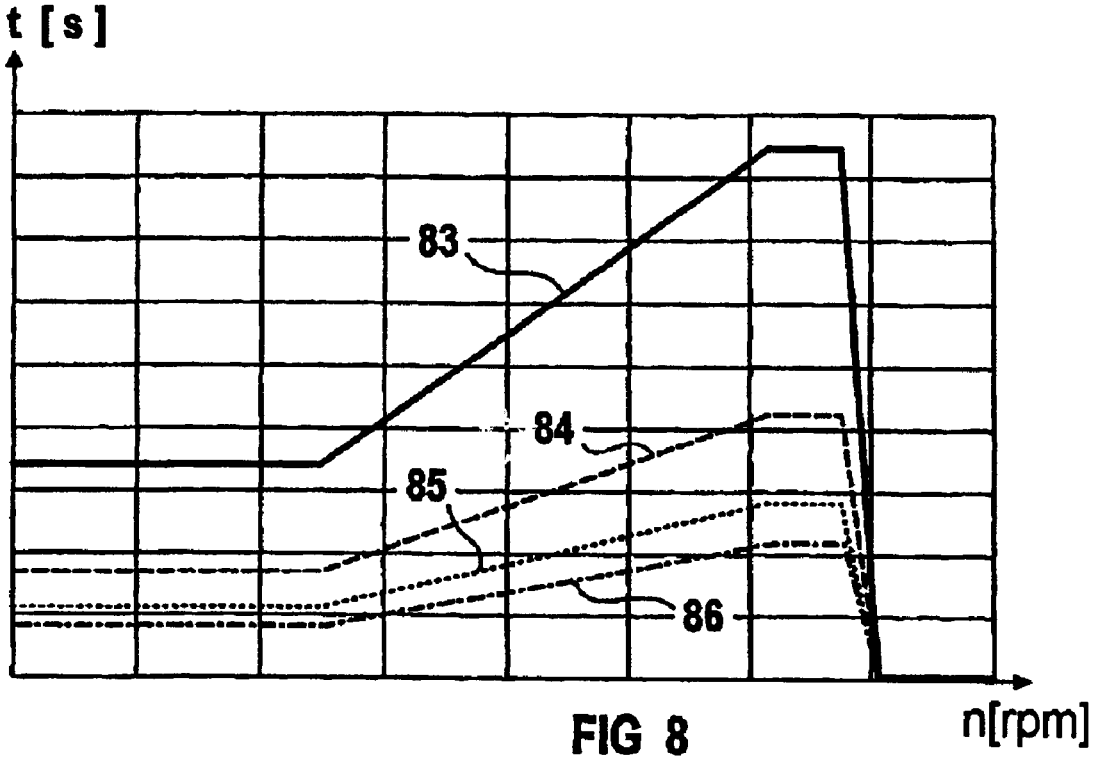
FIG. 8 shows characteristics of the third filters.

FIG. 8 shows a characteristic 83 which is provided by the characteristic transmitter 75 when only a single diesel generator is connected to the on-board power supply network 5.

As can be seen, a minimum ramp-up time and ramp-down time are defined (horizontal straight section) in a lower rotation speed range of the electric propeller motor, which corresponds approximately to the maneuvering region, that is to say ending at approximately ⅓ of the rated rotation speed. This ramp-up time and ramp-down time are governed by the maximum permissible rate of change in the wattless component emitted by the synchronous generator in the diesel generator that is switched on. As the rotation speed of the propeller motor 3 increases, the rate of change falls, that is to say the maximum permissible time within which the power consumption or emission of the diesel engines in the generator system may vary, becomes longer, as can be seen from the rising branch of curve 83 in FIG. 8.

When the on-board power supply network 5 is being fed from two diesel generators, a curve 84 is used. As can be seen in FIG. 8, this curve is located below the curve 83, that is to say faster power changes are possible both in the horizontal part of the curve and in the rising part.

If even more generators are connected, the curves 85 and 86, respectively, apply respectively to three or four diesel generators 57 . . . 61 which are switched on at the same time.

Figure 9:
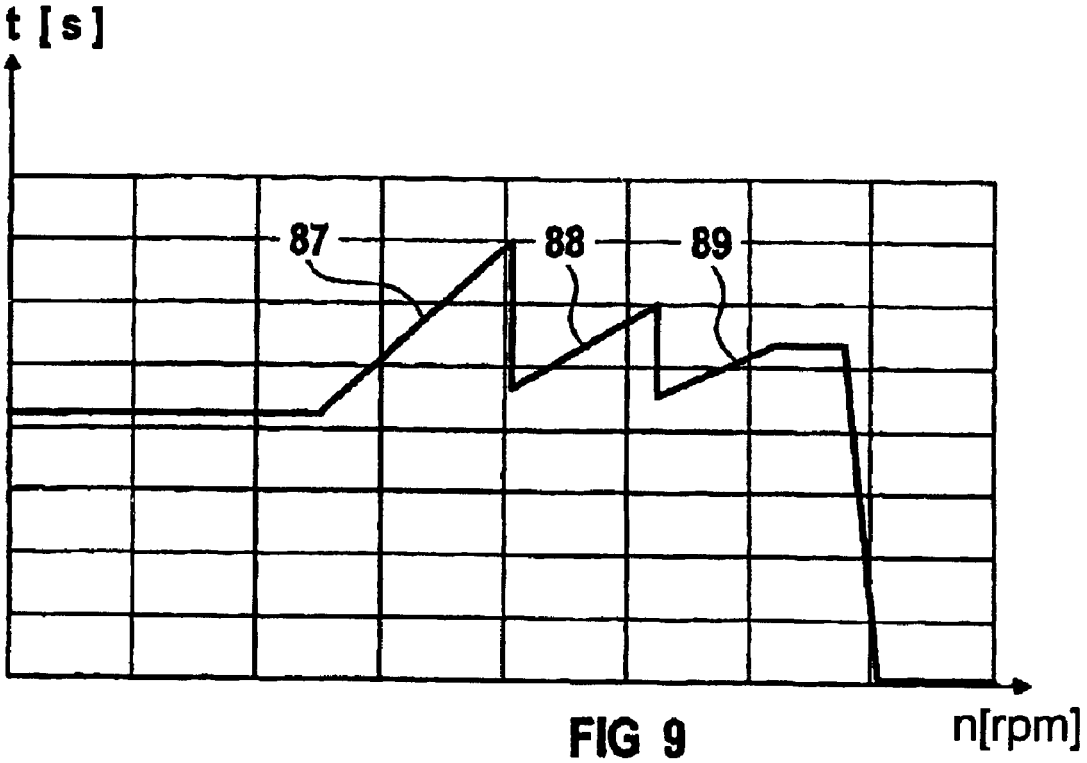
FIG. 9 shows the profile of the ramp-up time and ramp-down time of the current nominal value, for different numbers of feeding generators.

It is, of course, generally not expedient to start the propulsion load with all the diesel generators 57 . . . 61 from the start. If the diesel generators 57 . . . 61 are connected successively, as a function of the rotation speed of the propeller motor 3, that is to say as a function of the total power consumption of the ship propulsion system, this results in the permissible power rate of change having the profile shown in FIG. 9.

The left-hand horizontal section, including the left-hand rising branch with the reference symbol 87, corresponds to the corresponding part of the curve 84 with only two diesel generators. Beyond a certain rotation speed, which corresponds to a corresponding power consumption, a third diesel generator is connected, so that the rate of change of the power consumption is defined by a curve 88, into which the curve 87 merges suddenly. If the power consumption is even greater, the fourth diesel generator is finally also connected, so that the power may change in accordance with a curve 89.

The maximum permissible rate of change of the reference variables, as appropriate at the input 12, has an approximately sawtooth profile and, by connection of diesel generators, is kept approximately at a value (even in the high power range) which corresponds to maneuvering with only two active diesel generators.

In the quasi-steady state, the regulator 10 must be able to control the nominal value to be passed on to the actuating device 6, free of any limits. Otherwise, as already mentioned above, severe beating would occur in the electric propeller motor 3, which could become evident as mechanical oscillations in the ship. These can also promote or initiate cavitation on the ship's propeller 4. The limit to the rate of change therefore does not operate within the abovementioned amplitude window.

If the amplitude change remains independent of the rate of change within this window, the third filters 55 have no effect. Since the regulator 10 and hence also the actuating device 6 operate with their full dynamic response for this range, voltage fluctuations can occur in the on-board power supply network 5 since the excitation of the synchronous generators in the diesel generator system 56 cannot follow this sufficiently quickly. The actuating device 6 which, as already mentioned, operates as a frequency changer or converter, produces a reactive current which leads to voltage fluctuations due to the reactance of the synchronous generators. For this reason, the size of the window is set such that the reactive current which results from the power changes and flows into the on-board power supply network produces a voltage drop across the reactance of the generators that are connected, with this voltage drop in all cases being within the maximum permissible voltage tolerance of the on-board power supply network 5. Very rapid voltage fluctuations within the permissible voltage tolerance for the on-board power supply network 5 are thus not critical to its operation.

The separation between the lower and upper edge of the window and the instantaneous value of the nominal value of the control input 12 is a function of the magnitude of the rotation speed of the propeller motor 3, since the power factor on the on-board power supply network side depends on the drive level of the respective actuating device 6. Furthermore, the size of the window is proportional to the number of synchronous generators in the diesel generator system 56 which are feeding the on-board power supply network 5. The reason for this is the higher short-circuit rating in the on-board power supply network, which in turn is a result of the smaller reactance of the parallel-connected synchronous generators.

Figure 10:
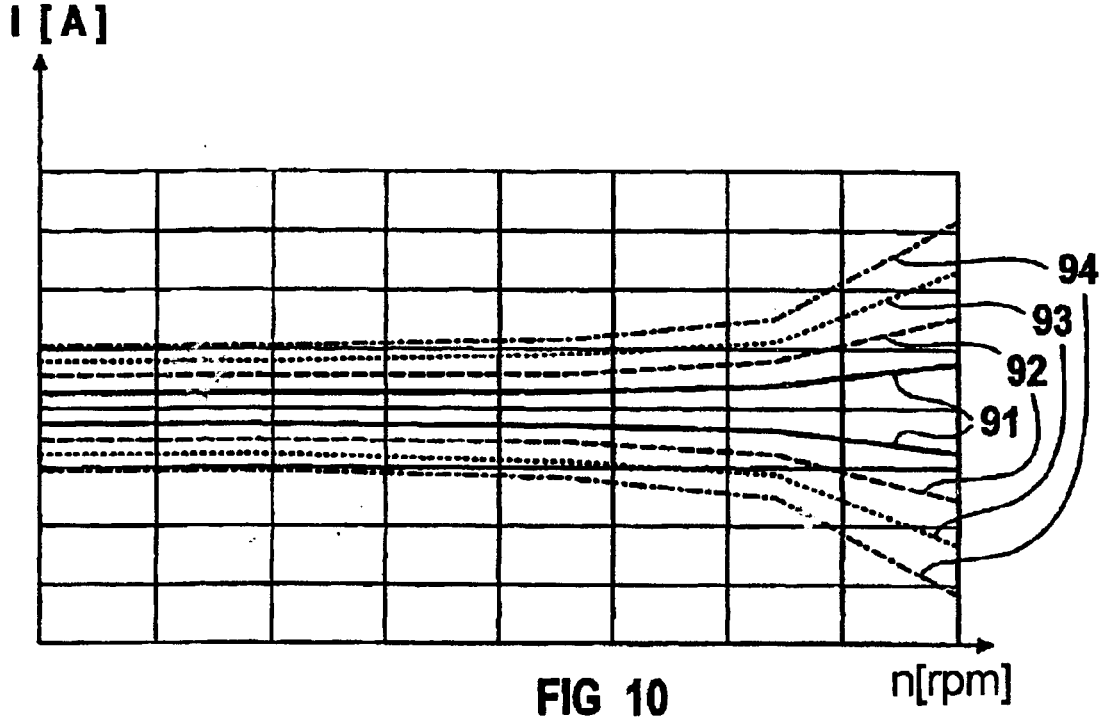
FIG. 10 shows the profile of the window for the third filters in which the rate of change is not restricted, related to a continuous value.
Figure 11:
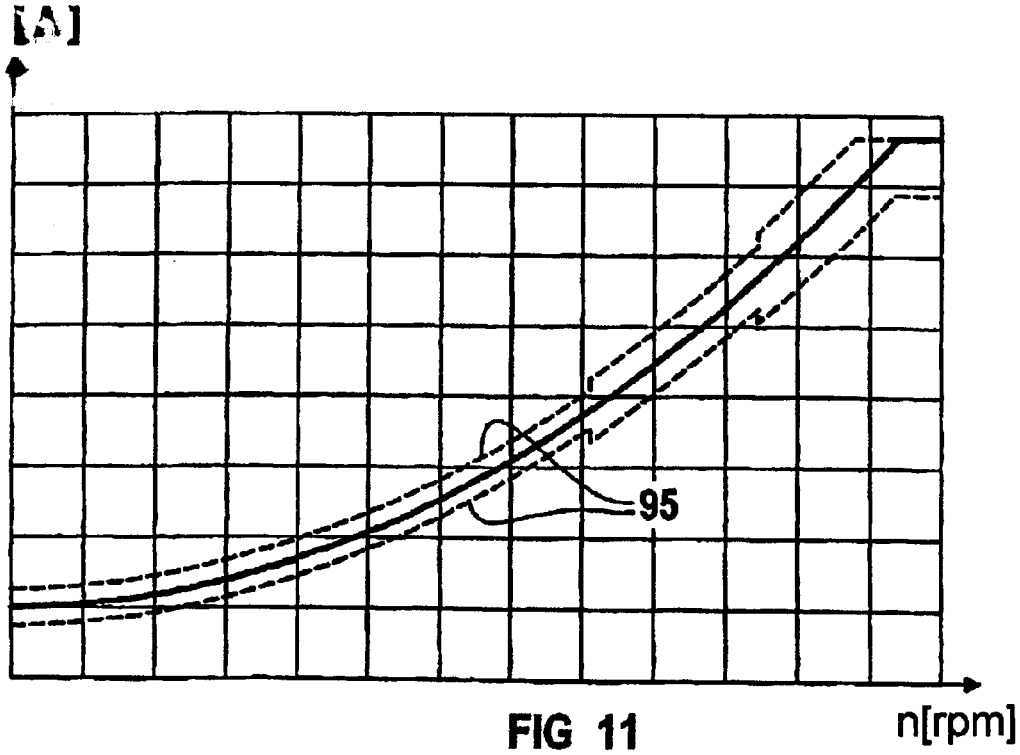
FIG. 11 shows the profile of the window as a function of the number of active generators.

FIG. 10 shows the variation range of the window for the nominal value at the control input 12 for the situation where the current drawn by the propeller motor 3 is not dependent on the rotation speed The smallest window, which is fixed between the two curve runs 91, applies to the situation where only one diesel generator is connected to the on-board power supply network. A somewhat larger window, corresponding to two curves 92, is obtained when there are two diesel generators, while the window widens, corresponding to the distance between the two curves 93 for two diesel generators to become a window corresponding to two curves 94 when there are a total of four diesel generators feeding the on-board power supply network 5. FIG. 11 shows, schematically, the width of the window when the propulsion power can be varied as a function of the rotation speed of the propeller motor 3. The width of the window is represented by two dashed curves 95.

The curves start at a low rotation speed with two diesel generators connected. A further diesel generator starts to operate at the first discontinuity point coming from the left, while four diesel generators are operated to the right of the second discontinuity point.

Furthermore, it may be expedient for the ramp-up time and ramp-down of the nominal value at the control input 12 to be varied as a function of the operating state of the diesel generator system which is feeding electrical power to the on-board power supply network, in which case different diesel generators of the diesel generator system may be used in different operating states.

The specific arrangement of the third filter 55 at the output of the regulator 10 also suppresses excessively rapid control processes which are not caused by the movement of the control lever 1 but by load changes on the ship's propeller 4. Load changes occur when rudder is applied or the rudder is moved back to the null position. The load changes result in rotation speed changes which must be regulated out and lead to a different power consumption. The regulator 10 is intrinsically very fast, and could possibly overcontrol the on-board power supply network, if it were not limited by the third filter 55.

It is self-evident that the three described filters may be used in any desired combination with one another.

The filters and the closed and open control loops have been described above in the form of classic electrical outline circuit diagrams, in order to make it easier to understand them. However, it is self-evident that, when implemented in practice, the filters and the closed and open control loops are generally in the form of programs or program sections. The nature of the description is not intended to imply any restriction to the specific type of practical implementation since it is clear to those skilled in the art how filters and regulators can be configured in digital form, as programs. Above all, the digital implementation has advantages for closed-loop control systems with long time constants or variable time constants.

A ship propulsion system includes an electrical on-board power supply network and an electrical propulsion system which is fed from it has a subordinate closed-loop control system for the propeller motor. The rotation speed of the propeller motor is governed by a higher-level regulator, whose reference variable comes from the control lever. Filter means are included, in order to suppress adverse effects on the operation of the ship resulting from the propulsion system having an excessively high dynamic response.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ship propulsion system for a ship including an electrical on-board power supply network, comprising:

a control lever arrangement, including a control lever, adapted to emit a control lever signal corresponding to the position of the control lever, a source for production of electrical power, an electrical actuating device, including a power input, a power output and a control input, wherein the power input is connected to the source;

an electric propeller motor, adapted to drive a ship's propeller and connected to the power output of the actuating device;

a rotation speed sensor, adapted to emit a rotation speed signal corresponding to the rotation speed of the ship's propeller;

a regulator device, including a regulator output, a nominal value input and an actual value input, wherein the control lever signal is fed into the nominal value input and the rotation speed signal is fed into the actual value input, and wherein the regulator output is connected to the control input of the actuating device; and filter means for suppressing rates of change of instantaneous values of the electrical power, emitted by the actuating device to the propeller motor, which cause adverse effects on the ship operation.

2. The ship propulsion system as claimed in claim 1, wherein the instantaneous value includes at least one of the value of a DC voltage and the root mean square value of an AC voltage.

3. The ship propulsion system as claimed in claim 1, wherein the instantaneous value is the frequency of an AC voltage.

4. The ship propulsion system as claimed in claim 1, wherein the adverse effects include oscillations in the ship's hull, caused by torque fluctuations from the propeller motor.

5. The ship propulsion system as claimed in claim 1, wherein the adverse effects include at least one of voltage spikes and frequency fluctuations in the on-board power supply network, caused by excessively fast movement of the control lever in the sense of reducing the rotation speed of the propeller motor.

6. The ship propulsion system as claimed in claim 1, wherein the adverse effects include at least one of voltage spikes, voltage dips and frequency fluctuations in the on-board power supply network, caused by load changes on the propeller caused by at least one of rudder movements, changes to the propeller pitch and, in the case of ships with other propulsion runs, changes to the rotation speed of another propulsion run.

7. The ship propulsion system as claimed in claim 1, wherein the adverse effects are formed by dynamic changes to the ship's propeller as a function of the speed of motion.

8. The ship propulsion system as claimed in claim 1, wherein the filter means include first filter means for suppressing amplitude fluctuations in the signal at the control input, when at least one of the frequency of the amplitude fluctuations is above a predetermined limit, and the amplitude of the amplitude fluctuations is below a predetermined limit.

9. The ship propulsion system as claimed in claim 8, wherein the first filter means include amplitude filters.

10. The ship propulsion system as claimed in claim 8, wherein the first filter means include frequency filters.

11. The ship propulsion system as claimed in claim 8, wherein the first filter means are located upstream of the actual value input, such that the actual value signal is supplied via the first filter means.

12. The ship propulsion system as claimed in claim 8, wherein the first filter means are arranged between the regulator output and the control input.

13. The ship propulsion system as claimed in claim 8, wherein the first filter means are integrated in the regulator device.

14. The ship propulsion system as claimed in claim 8, wherein the first filter means are designed to be adaptive, such that the respective filter characteristic value is dependent on the rotation speed of the ship's propeller.

15. The ship propulsion system as claimed in claim 8, wherein the first filter means include a filter means control input into which the rotation speed signal is fed.

16. The ship propulsion system as claimed in claim 1, wherein the regulator device includes a PI characteristic.

17. The ship propulsion system as claimed in claim 1, wherein at least one of the regulator device and the first filter means is designed to operate in at least one of digital form, analog form and mixed analog/digital form.

18. The ship propulsion system as claimed in claim 1, wherein at least one of the regulator device and the filter means is in the form of a program in at least one of a microprocessor and a microcontroller.

19. The ship propulsion system as claimed in claim 1, wherein the regulator device includes, in series, a proportional regulator, an integral regulator and an addition element, with one input of the proportional regulator forming an input into which the closed-loop control difference is fed, one output of the proportional regulator being connected to one input of an integral regulator, and the output of the proportional regulator and the output of the integral regulator being connected to inputs of the addition element, whose output forms the regulator output and is fed back to the input of the proportional regulator.

20. The ship propulsion system as claimed in claim 19, wherein the feedback is set such that it results in a steady-state closed-loop control error of approximately 0.2% to 2%.

21. The ship propulsion system as claimed in claim 20, wherein the steady-state closed-loop control error is compensated for by a corrected nominal value n*.

22. The ship propulsion system as claimed in claim 21, wherein a nominal value compensation $n_L$* is carried out as a function of an estimated load.

23. The ship propulsion system as claimed in claim 22, wherein the estimated load is determined on the basis of a characteristic from an uncompensated rotation speed nominal value.

24. The ship propulsion system as claimed in claim 1, wherein the actuating device is in the form of a regulator, whose nominal value input forms the control input for the actuating device.

25. The ship propulsion system as claimed in claim 1, wherein the actuating device emits at its power output, a DC voltage whose value is dependent on the position of the control lever.

26. The ship propulsion system as claimed in claim 1, wherein the actuating device emits at its power output an AC voltage, whose frequency is dependent on the position of the control lever.

27. The ship propulsion system as claimed in claim 1, wherein the actuating device is designed such that the current which the actuating device emits to the propeller motor is adjusted via the signal at the control input.

28. The ship propulsion system as claimed in claim 1, wherein the filter means includes second filter means including a controlled ramp-up transmitter, which defines a ramp-up time within which the rotation speed of the propeller motor follows the position of the control lever in the sense of acceleration as a function of a characteristic.

29. The ship propulsion system as claimed in claim 28, wherein the characteristic is continuous in the sense that the characteristic has no discontinuities.

30. The ship propulsion system as claimed in claim 28, wherein the second filter means are located between the control lever and the nominal value input of the closed-loop control device.

31. The ship propulsion system as claimed in claim 28, wherein the second filter means includes a control input into which the rotation speed signal is fed.

32. The ship propulsion system as claimed in claim 28, wherein the ramp-up time is at least one of constant and short, and slightly rising and short, in the rotation speed range between 0 and approximately ⅓ of the rated rotation speed.

33. The ship propulsion system as claimed in claim 28, wherein the ramp-up time rises more sharply with the rotation speed of the propeller motor for a rotation speed range of the propeller motor above ¼ of the rated rotation speed.

34. The ship propulsion system as claimed in claim 33, wherein the ramp-up time rises even more sharply with the rotation speed of the propeller motor than for the rotation speed range which is below half the rated rotation speed than for an upper rotation speed range of the propeller motor which is above half the rated rotation speed.

35. The ship propulsion system as claimed in claim 28, wherein the second filter means is designed to operate in at least one of digital form, in analog form, and in mixed digital/analog form.

36. The ship propulsion system as claimed in claim 28, wherein a ramp-down time, which is predetermined in the second filter means, is at most equal to the ramp-up time, which is dependent on the rotation speed, in the rotation speed ranges of the propeller motor up to ¼.

37. The ship propulsion system as claimed in claim 28, wherein a ramp-down time, which is predetermined in the second filter means, is at most constant as the rotation speed of the propeller motor decreases.

38. The ship propulsion system as claimed in claim 28, wherein a ramp-down time, which is predetermined in the second filter means, is continuous, in the sense that it has no discontinuities.

39. The ship propulsion system as claimed in claim 28, wherein a ramp-down time, which is predetermined in the second filter means, is approximately 0.2 s per rpm.

40. The ship propulsion system as claimed in claim 1, wherein the filter means includes third filter means which limit the rate of change of the power consumption by the propeller motor.

41. The ship propulsion system as claimed in claim 40, wherein the third filter means are set up to limit the rate of change of the output variable from the closed-loop control device for the electrical actuating device, taking into account limit values which are dependent on the source which feeds electrical power to the on-board power supply network.

42. The ship propulsion system as claimed in claim 40, wherein the third filter means are designed such that they limit the rate of change of the output variable in one direction, which is referred to as at least one of a ramp-up time and ramp-up rate of change, to a different value than the rate of change of the output variable in the other direction, which is referred to as at least one of a ramp-down time and ramp-down rate of change.

43. The ship propulsion system as claimed in claim 42, wherein at least either the value for the ramp-up time or the value for the ramp-down time, which is or are limited by the third filter means, can be varied in the same sense as the change in the magnitude of the actual rotation speed of the electric propeller motor.

44. The ship propulsion system as claimed in claim 41, wherein, in a lower rotation speed range of the electric propeller motor or of the ship's propeller, a ramp-up time and a ramp-down time, which are predetermined by the third filter means, are matched to a maximum permissible rate of change of a wattless component emitted by the source which feeds the on-board power supply network.

45. The ship propulsion system as claimed in claim 41, wherein the source includes at least two generators, and wherein at least one of a ramp-up time and a ramp-down time, predetermined by the third filter means, are variable in the opposite sense to a change in at least one of the number and physical size of the active generators.

46. The ship propulsion system as claimed in claim 41, wherein at least one of a ramp-up time and a ramp-down time, predetermined by the third filter means, is variable as a function of the operating state of the source.

47. The ship propulsion system as claimed in claim 41, wherein the third filter means are designed such that a window is provided, within which the limiting of at least one of a ramp-up time and of a ramp-down time does not operate.

48. The ship propulsion system as claimed in claim 47, wherein the position of the window is essentially synunetrical with respect to the output variable, at least in one range of the output variable from the closed-loop control device, such that limiting occurs at approximately the same rate of change in both directions.

49. The ship propulsion system as claimed in claim 47, wherein, in order to provide the window, the output signal from the closed-loop control device is fed back into a control input of the third filter means.

50. The ship propulsion system as claimed in claim 47, wherein the size of the window can be adjusted such that a reactive current in the on-board power supply network, which results from the rate of change of the power consumption of the propeller motor, produces a voltage drop which is within the maximum permissible voltage tolerance of the on-board power supply network across a reactance of the source.

51. The ship propulsion system as claimed in claim 47, wherein the source includes at least two generators, and wherein the size of the window is larger than the number of active generators.

52. The ship propulsion system as claimed in claim 41, wherein a ramp-up time and a ramp-down time of the current nominal value are varied in the same sense as the change in the magnitude of the actual rotation speed of the electric propeller motor.

53. The ship propulsion system as claimed in claim 41, wherein a ramp-up time and a ramp-down time of the current nominal value are varied in inverse proportion to the number and physical size of the generators which feed electrical power into the on-board power supply network.

54. The ship propulsion system as claimed in claim 41, wherein the third filter means are designed such that they operate on a microprocessor basis, in at least one of analog form and in mixed digital/analog form.

55. The ship propulsion system as claimed in claim 22, wherein the estimated load is determined on the basis of a characteristic from the rotation speed actual value.

56. The ship propulsion system as claimed in claim 1, wherein the filter means includes second filter means including a controlled ramp-up transmitter, which defines a ramp-up time within which the rotation speed of the propeller motor follows the position of the control lever in the sense of acceleration as a function of the rotation speed of the propeller motor.

57. The ship propulsion system as claimed in claim 28, wherein a ramp-up time rises more sharply with the rotation speed of the propeller motor for a rotation speed range of the propeller motor above ⅓ of the rated rotation speed.

58. The ship propulsion system as claimed in claim 28, wherein a ramp-down time, which is predetermined in the second filter means, is at most equal to a ramp-up time, which is dependent on the rotation speed, in the rotation speed ranges of the propeller motor up to ⅓, of the rated rotation speed.

59. The ship propulsion system as claimed in claim 28, wherein a ramp-down time, which is predetermined in the second filter means, is considerably shorter than a ramp-up time, which is dependent on the rotation speed, in the subsequent rotation speed range of the propeller motor.

60. The ship propulsion system as claimed in claim 42, wherein at least either the value for the ramp-up time or the value for the ramp-down time, which is or are limited by the third filter means, can be varied in proportion to the magnitude of the actual rotation speed of the electric propeller motor.

61. The ship propulsion system as claimed in claim 41, wherein the source includes at least two generators, and wherein at least one of a ramp-up time and a ramp-down time, predetermined by the third filter means, are variable in inverse proportion to at least one of the number and physical size of the active generators.

62. The ship propulsion system as claimed in claim 47, wherein the size of the window can be adjusted such that a reactive current in the on-board power supply network, which results from the rate of change of the power consumption of the propeller motor, produces a voltage drop which is within the maximum permissible voltage tolerance of the on-board power supply network across a reactance of a synchronous generator.

63. The ship propulsion system as claimed in claim 41, wherein a ramp-up time and a ramp-down time of the current nominal value are varied in proportion to the magnitude of the actual rotation speed of the electric propeller motor.

* * * * *